US005359461A

United States Patent [19]

Rice et al.

[11] Patent Number: 5,359,461

[45] Date of Patent: Oct. 25, 1994

[54] PORTABLE COSMETIC MIRROR APPARATUS

[76] Inventors: Virginia Rice, 300 E. H. St. #155, Benicia, Calif. 94510; Maybelle I. Gailas, 214 Twin Lake Dr., Elyria, Ohio 44035-4700

[21] Appl. No.: 98,042

[22] Filed: Jul. 28, 1998

[51] Int. Cl.[5] ..... G02B 7/18

[52] U.S. Cl. ..... 359/874; 359/872; 248/469; 248/472; 248/474

[58] Field of Search ..... 359/838, 849, 872; 248/469, 472, 188.6, 166, 476, 443, 447, 411, 460, 461, 462, 188.5

[56] References Cited

U.S. PATENT DOCUMENTS

| | | | |
|---|---|---|---|
| 3,877 | 10/1878 | William | 359/860 |
| 2,075,579 | 8/1978 | Wilcox | 359/860 |
| 4,544,120 | 10/1985 | Lowell et al. | 248/462 |
| 4,966,450 | 10/1990 | Mori | 359/881 |
| 5,124,857 | 6/1992 | Pitz | 359/881 |

*Primary Examiner*—Eugene R. LaRoche
*Assistant Examiner*—Vu Le
*Attorney, Agent, or Firm*—Hugh E. Smith

[57] ABSTRACT

A portable cosmetic mirror which includes a stand that may be adjusted to various heights for allowing a user to accurately position the mirror such that both hands may be utilized for cosmetic application, hairstyling, or the like. Alternate embodiments of the apparatus further include a hair dryer holding assembly for positioning a hair dryer for hands-free use with the mirror and a magnification assembly in which a magnifying lens is removably positioned upon the mirror.

4 Claims, 4 Drawing Sheets

PORTABLE COSMETIC MIRROR APPARATUS

BACKGROUND OF THE INVENTION

1. Field of the Invention

The present invention relates to mirrors and more particularly pertains to a portable cosmetic mirror apparatus including a stand that may be adjusted to various heights for allowing a user to accurately position the mirror such that both hands may be utilized for cosmetic application, hairstyling, or the like.

2. Description of the Prior Art

The use of mirrors is known in the prior art. More specifically, mirrors heretofore devised and utilized for the purpose of personal grooming are known to consist basically of familiar, expected and obvious structural configurations, notwithstanding the myriad of designs encompassed by the crowded prior art which have been developed for the fulfillment of countless objectives and requirements.

For example, a height-adjustable rear view hairstyling mirror is illustrated in U.S. Pat. No. 4,269,382 which frees the user's hands and allows viewing the back of the head while using two hands for hairstyling purposes. The device includes a mirror attached to a frame having three legs connected by hinges which allows the frame to close flatly for storing against a wall. The mirror is vertically adjustable on the frame which has a number of spaced holes for hanging the mirror by means of bolt heads extending out from the mirror's frame.

A self-styling and utility mirror with four surfaces is disclosed in U.S. Pat. No. 4,050,790 including four planar surfaces connected along adjacent edges thereof such that the two outer surfaces are angularly movable with respect to the two inner surfaces. The self-styling mirror is secured upon a vertical pole and is vertically movable up and down the pole.

Another patent of interest is U.S. Pat. No. 3,730,612 which describes a back-of-the-head viewing system designed to function alongside an existing mirror to provide a back-of-the-head view thereof. The unit is comprised of a bracket having a vertical bar upon which is slidably and rotatably mounted an arm having on one end thereof a suspended mirror which may be positioned behind the head of a user.

While these devices fulfill their respective, particular objectives and requirements, the aforementioned patents do not describe a portable cosmetic mirror which may be adjusted to various heights for allowing a user to accurately position the mirror that includes a hair dryer holding assembly for positioning a hair dryer proximate the mirror and a magnification assembly in which a magnifying lens is removably positioned upon the mirror. In this respect, the portable cosmetic mirror apparatus according to the present invention substantially departs from the conventional concepts and designs of the prior art, and in so doing provides an apparatus primarily developed for the purpose of allowing a user to accurately position the mirror such that both hands may be utilized for cosmetic application, hairstyling, or the like.

SUMMARY OF THE INVENTION

In view of the foregoing disadvantages inherent in the known types of mirrors now present in the prior art, the present invention provides a new portable cosmetic mirror apparatus construction wherein the same can be utilized to provide an accurately positioned mirror such that both hands may be utilized for cosmetic application, hairstyling, or the like. As such, the general purpose of the present invention, which will be described subsequently in greater detail, is to provide a new portable cosmetic mirror apparatus which has many of the advantages of the mirrors mentioned heretofore and many novel features that result in a portable cosmetic mirror apparatus which is not anticipated, rendered obvious, suggested, or even implied by any of the prior art mirrors, either alone or in any combination thereof.

To attain this, the present invention essentially comprises a portable cosmetic mirror apparatus which includes a stand that may be adjusted to various heights for allowing a user to accurately position the mirror such that both hands may be utilized for cosmetic application, hairstyling, or the like. The apparatus comprises a telescoping pole upon which a mirror is pivotally mounted. The telescoping pole is supported in an upright position by a base assembly having a plurality of folding legs which, along with the telescoping pole, may be compacted for storage and traveling purposes. Alternate embodiments of the apparatus further include a hair dryer holding assembly for positioning a hair dryer for hands-free use with the mirror and a magnification assembly in which a magnifying lens is removably positioned upon the mirror.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable cosmetic mirror apparatus which has many of the advantages of the mirrors mentioned heretofore and many novel features that result in a portable cosmetic mirror apparatus which is not anticipated, rendered obvious, suggested, or even implied by any of the prior art mirrors, either alone or in any combination thereof.

It is another object of the present invention to provide a new portable cosmetic mirror apparatus which may be easily and efficiently manufactured and marketed.

It is a further object of the present invention to provide a new portable cosmetic mirror apparatus which is of a durable and reliable construction.

An even further object of the present invention is to provide a new portable cosmetic mirror apparatus which is susceptible of a low cost of manufacture with regard to both materials and labor, and which accordingly is then susceptible of low prices of sale to the consuming public, thereby making such portable cosmetic mirror apparatuses economically available to the buying public.

Still yet another object of the present invention is to provide a new portable cosmetic mirror apparatus which provides in the apparatuses and methods of the prior art some of the advantages thereof, while simultaneously overcoming some of the disadvantages normally associated therewith.

Still another object of the present invention is to provide a new portable cosmetic mirror apparatus which includes a stand that may be adjusted to various heights.

Yet another object of the present invention is to provide a new portable cosmetic mirror apparatus for allowing a user to accurately position the mirror such that both hands may be utilized for cosmetic application, hairstyling, or the like.

Even still another object of the present invention is to provide a new portable cosmetic mirror apparatus which includes a hair dryer holding assembly for positioning a hair dryer for hands-free use with the mirror.

Even still yet another object of the present invention is to provide a new portable cosmetic mirror apparatus which includes a magnification assembly in which a magnifying lens is removably positioned upon the mirror.

Even still yet another object of the present invention is to provide a new portable cosmetic mirror apparatus which may be easily compacted for travel and storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
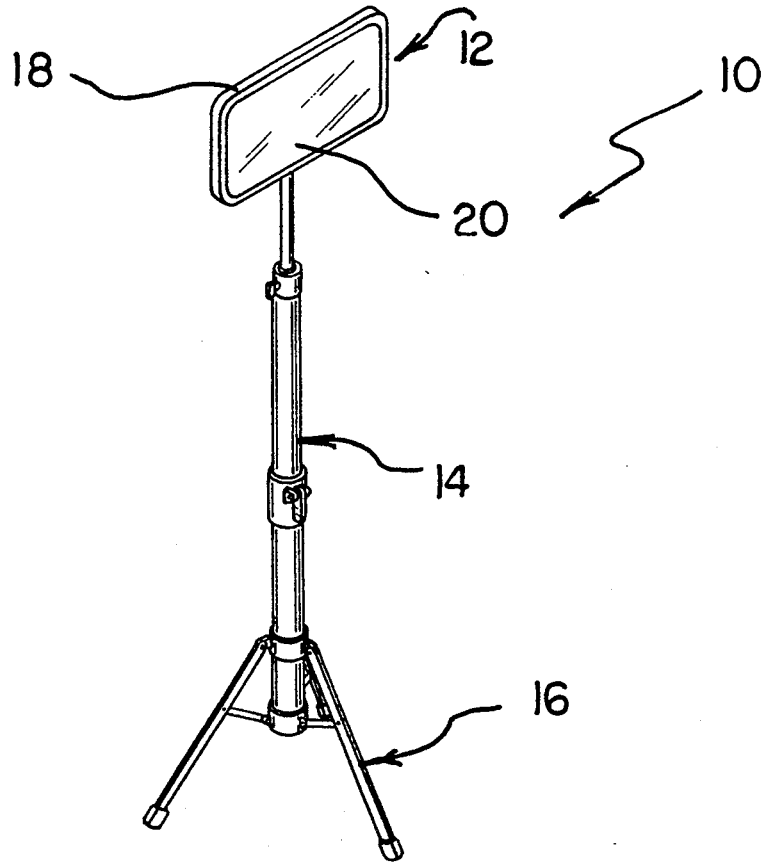
FIG. 1 is a perspective view of a first embodiment of a portable cosmetic mirror apparatus comprising the present invention.
Figure 2:
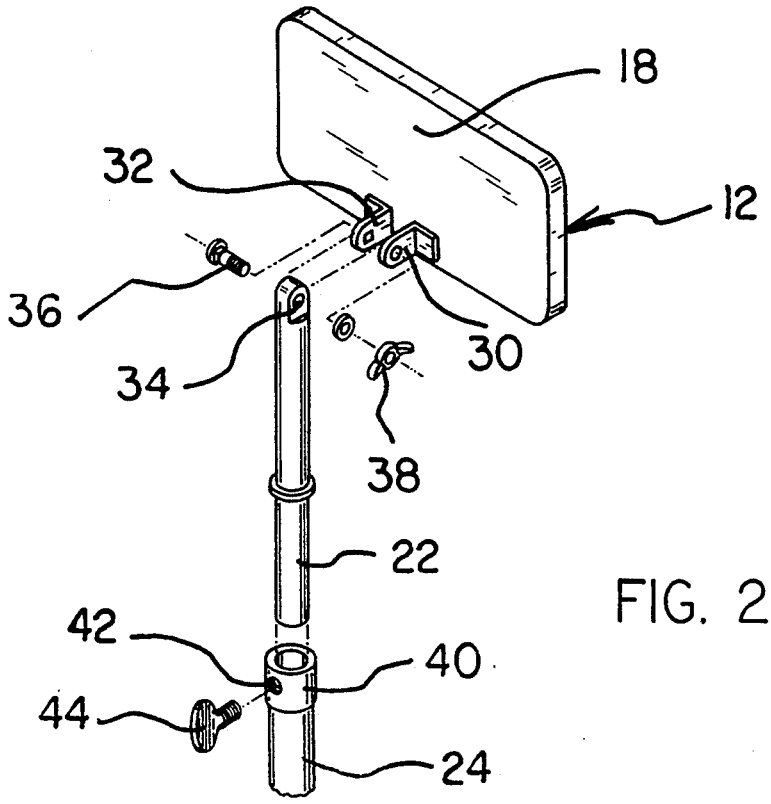
FIG. 2 is a further perspective view of a portion of the present invention.
Figure 3:
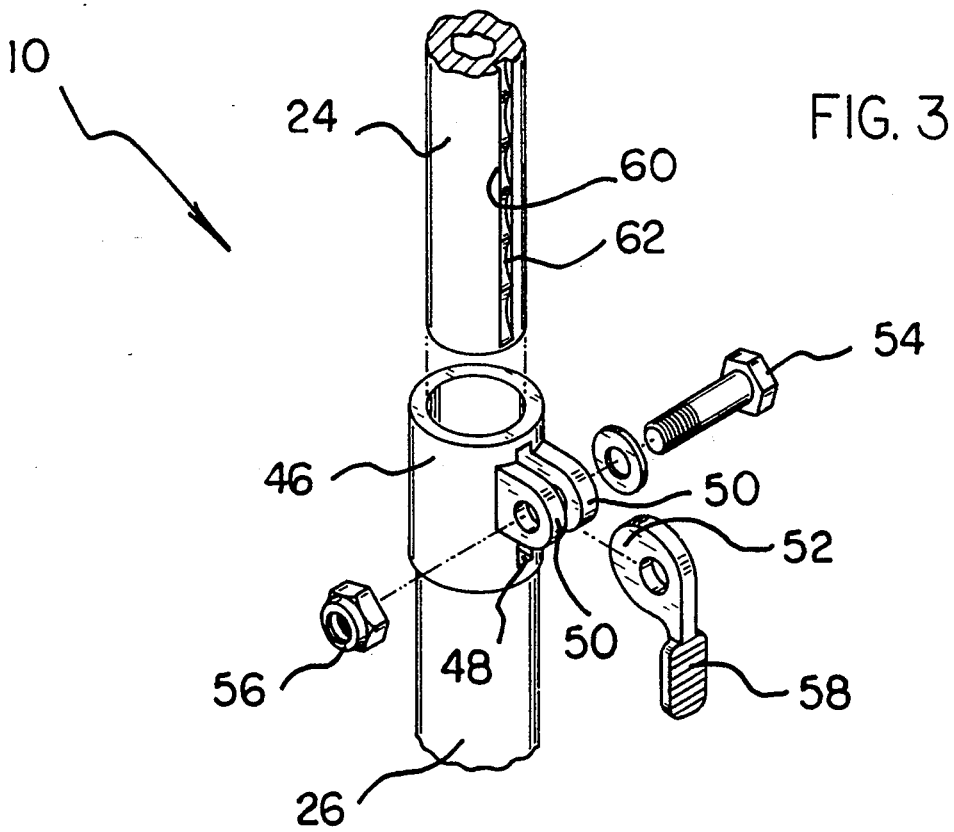
FIG. 3 is an enlarged, exploded view of further portion of the invention.

With reference now to the drawings, and in particular to FIGS. 1–5 thereof, a new portable cosmetic mirror apparatus embodying the principles and concepts of the present invention and generally designated by the reference numeral 10 will be described.

The portable cosmetic mirror apparatus 10 comprises a mirror assembly 12 positioned upon a telescoping pole 14 which is supported in an upright position by a base assembly 16, as best illustrated in FIG. 1. The mirror assembly 12 includes a substantially rectangular mirror frame 18 which supports a flat mirror glass 20 partially therein. The mirror frame 18 is pivotally mounted to a top of the telescoping pole 14 such that it may be pivoted with respect thereto. The telescoping pole 14 comprises an upper member 22 to which the mirror frame 18 is pivotally attached. The upper member is slidably received within a medial member 24. Similarly, the medial member 24 is slidably received within a lower member 26 which is supported in an upright position by the base assembly 16. The sliding relationship between the members 22–26 allows the telescoping pole 14 to be adjusted to various heights by a user.

The base assembly 16 comprises a plurality of legs 28 which are pivotally and slidably connected to the lower member 26 such that they may be selectively extended or retracted by a user. By positioning the members 22–26 within each other and folding the plurality of legs 28 against the lower member 26, the portable cosmetic mirror apparatus 10 may be compactly stored.

In use, the portable cosmetic mirror apparatus 10 may be erected by an extension of the plurality of legs 28 and a selective positioning of the upper member 22 and the medial member 24 to a desired height. The mirror frame 18 and its associated mirror glass 20 may then be selectively pivoted upon the upper member to an appropriate position. In this manner, the portable cosmetic mirror apparatus 10 may be adjusted to various heights and angles for allowing a user to accurately position the mirror such that both hands may be utilized for cosmetic application, hairstyling, or the like. The design of the portable cosmetic mirror apparatus 10 further provides it with an ability to be compactly stored for traveling and the like.

More specifically, it will be noted that the portable cosmetic mirror apparatus 10 comprises a mirror assembly 12 having a substantially rectangular mirror frame 18 which supports a mirror glass 20 in a viewing position partially therewithin. The mirror frame 18 comprises a pair of L-shaped brackets 30, 32 which are fixedly secured to a back area thereof in a spaced relationship. The first L-shaped bracket 30 includes an unlabeled circular aperture therethrough and the second L-shaped bracket 32 includes a square shaped aperture therethrough. The upper member 22 of the telescoping pole 14 includes, at a top end thereof, a flattened area having a circular aperture 34 extending therethrough. The flattened area is operable to be received between the L-shaped brackets 30, 32, whereby a carriage bolt 36 may pass through the unlabeled apertures in the brackets and threadably engage a wing nut 38 in a well understood manner. Once a desired position of the mirror assembly 12 with respect to the telescoping pole 14 is found by a user, the position may be secured by a tightening of the wing nut 38 onto the carriage bolt 36.

The mirror assembly 12 is supported by the telescoping pole 14 which comprises the upper, medial, and lower members 22–26 which are operable to be telescopically extended to various heights. To secure the telescoping pole 14 at a desired height, the medial member 24 includes a medial lock 40 at a top end thereof which has a threaded medial lock aperture 42 extending therethrough, as best viewed in FIG. 2. A thumb screw 44 is received through the threaded medial lock aperture 42 whereby it may be selectively engaged to the upper member 22 to secure a position thereof with respect to the medial member 24.

The lower member 26 includes a lower lock 46 at a top end thereof which comprises a through-extending slot and a pair of spaced tabs 50 having unlabeled apertures therethrough. A cam 52 is secured between the tabs 50 by a bolt 54 which passes through the same. The bolt 54 is engaged to a lock nut 56 which secures its position through both the tabs 50 and the cam 52. A thumb lever 58 is integrally or otherwise fixedly secured to the cam 52 and is operable to selectively rotate the cam 52 about the bolt 54 in a well understood manner. The medial member 24 further comprises a journal 60 extending a longitudinal length thereof and having a plurality of grooves 62 integrally formed therein. The cam 52 may be selectively operated by a user to engage any of the plurality of grooves 62 to secure a position of the medial member 24 with respect to the lower member 26 by a pivoting motion of the thumb lever 58. This allows a secure position of the medial member 24 with respect to the lower member 26 to be obtained without a scratching or scarring of the exterior of the medial member and further precludes a rotational movement of the medial member with respect to the lower member.

Figure 4:
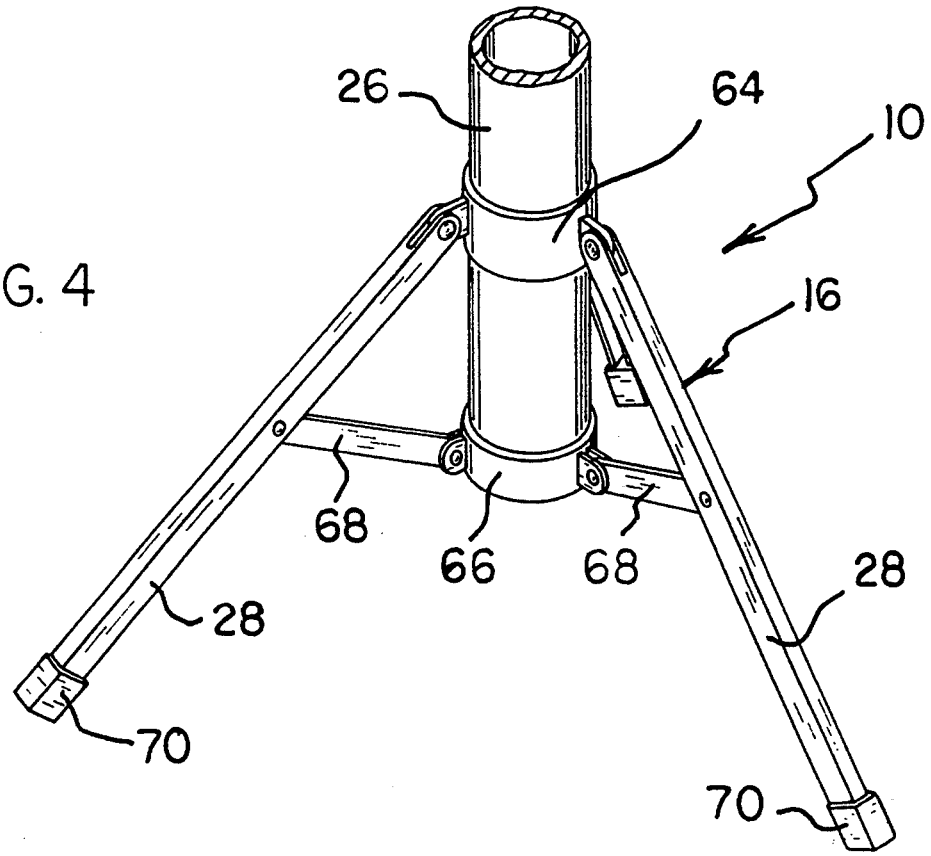
FIG. 4 is a further perspective view of an even further portion of the present invention.

The base assembly 16 comprises a slider 64 which is slidably disposed upon the lower member 26, as best illustrated in FIG. 4. An end cap 66 is secured to a lower end of the lower member 26 and is similar in construction to the slider 64. A plurality of legs 28, the preferred embodiment comprising three of such legs, are attached to the slider 64 in a spaced relationship along a circumference thereof. The plurality of legs 28 include an equal number of supporting arms 68 which are pivotally mounted to the end cap 66. This arrangement allows the plurality of legs to be extended into a tripod arrangement as best shown in FIG. 4, or alternatively, folded flatly against the lower member 26 as best illustrated in the phantom detail of FIG. 5. Each of the plurality of legs 28 includes a padded foot which protects a floor surface upon which the portable cosmetic mirror apparatus 10 is positioned from scarring. It should be realized that any number of legs may be utilized to form the base assembly 16.

Figure 5:
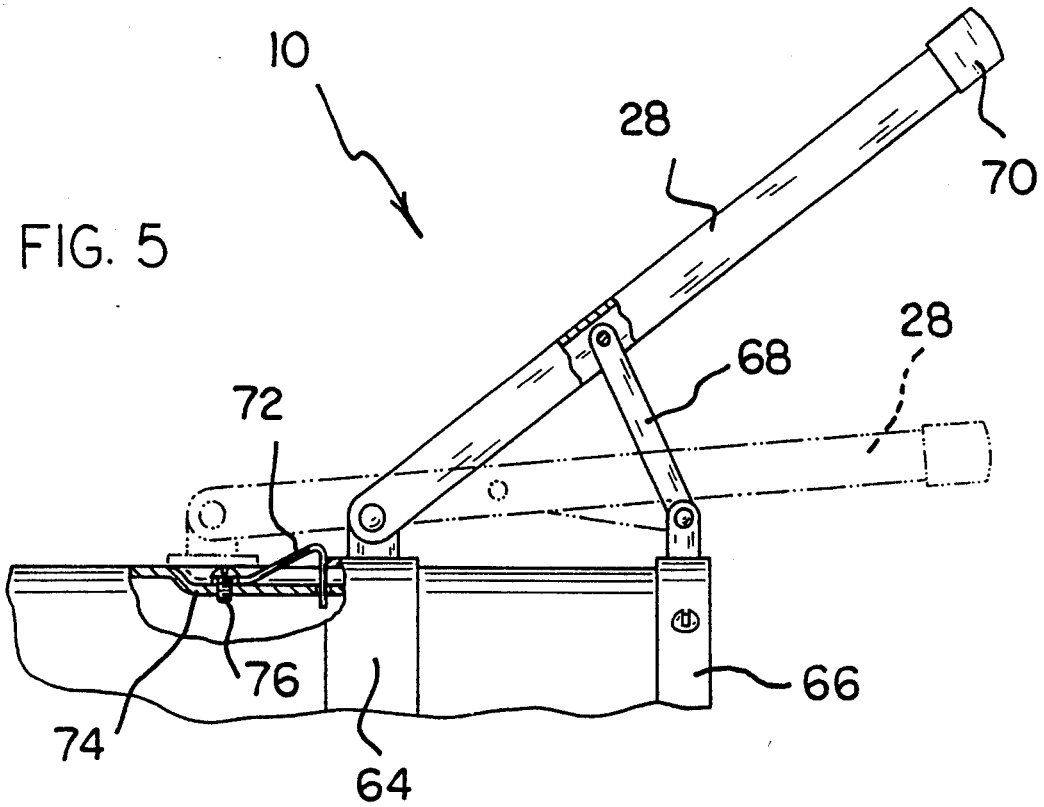
FIG. 5 is a side view of the invention detailing a motion of the legs.

When the plurality of legs 28 are in the stored position against the lower member 26, a spring 72 engages the slider 64 to secure the same in the stored position. The spring 72 is mounted in a recessed area 74 of the lower member 26 and secured thereto by a fastener 76, as best illustrated in FIG. 5. The spring 72 is further operable to engage the slider 64 upon an extension of the plurality of legs 28 and secure the same in an extended position.

Figure 6:
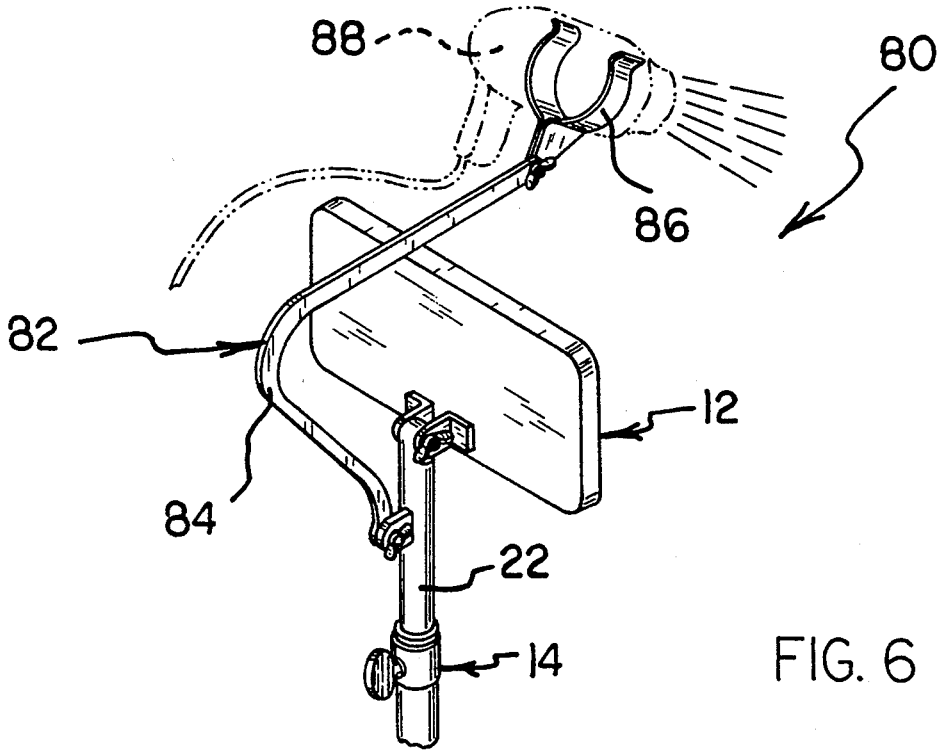
FIG. 6 is a perspective view of a second embodiment of the present invention.

A second embodiment of the present invention as generally designated by the reference numeral 80, which comprises substantially all of the features of the foregoing embodiment 10 and which further comprises a holding assembly 82 will now be described. As best shown in FIGS. 6, it can be shown that holding assembly 82 comprises a holding arm 84 which is pivotally connected to the upper member 22. The holding arm 84 extends from the upper member 22 to an area substantially above the mirror assembly 12 wherein it then extends outwardly therefrom to pivotally support a resilient clamp 86 upon an end thereof. The resilient clamp 86 is operable to releasably secure a hair appliance, such as a hair dryer 88, to the holding arm 84 whereby it may be positioned for a hands-free use by a user.

Figure 7:
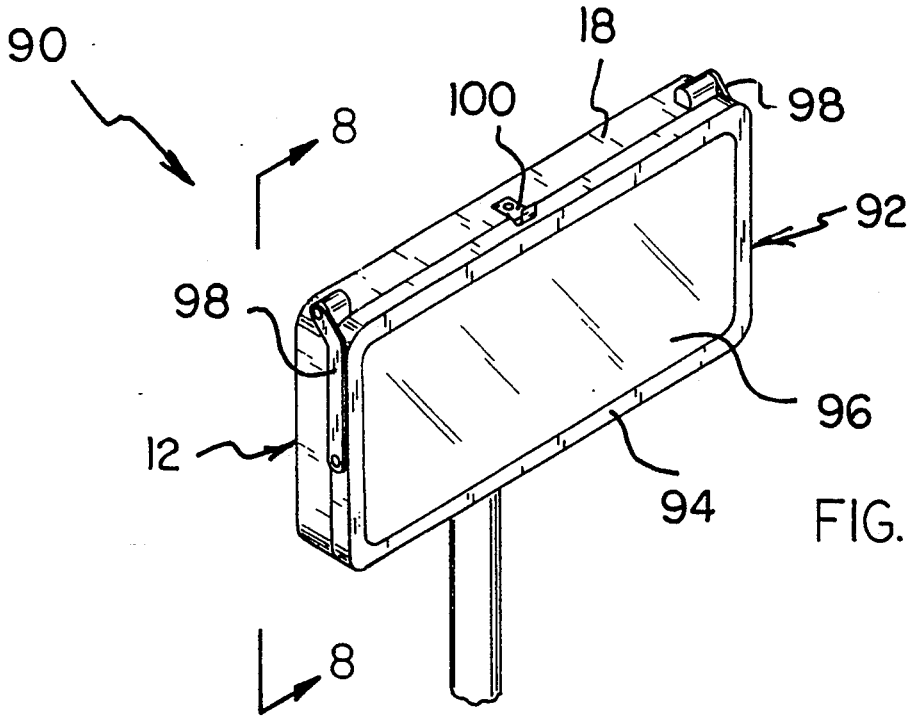
FIG. 7 is a perspective view of a portion of a third embodiment of a portable cosmetic mirror apparatus comprising the present invention.
Figure 8:
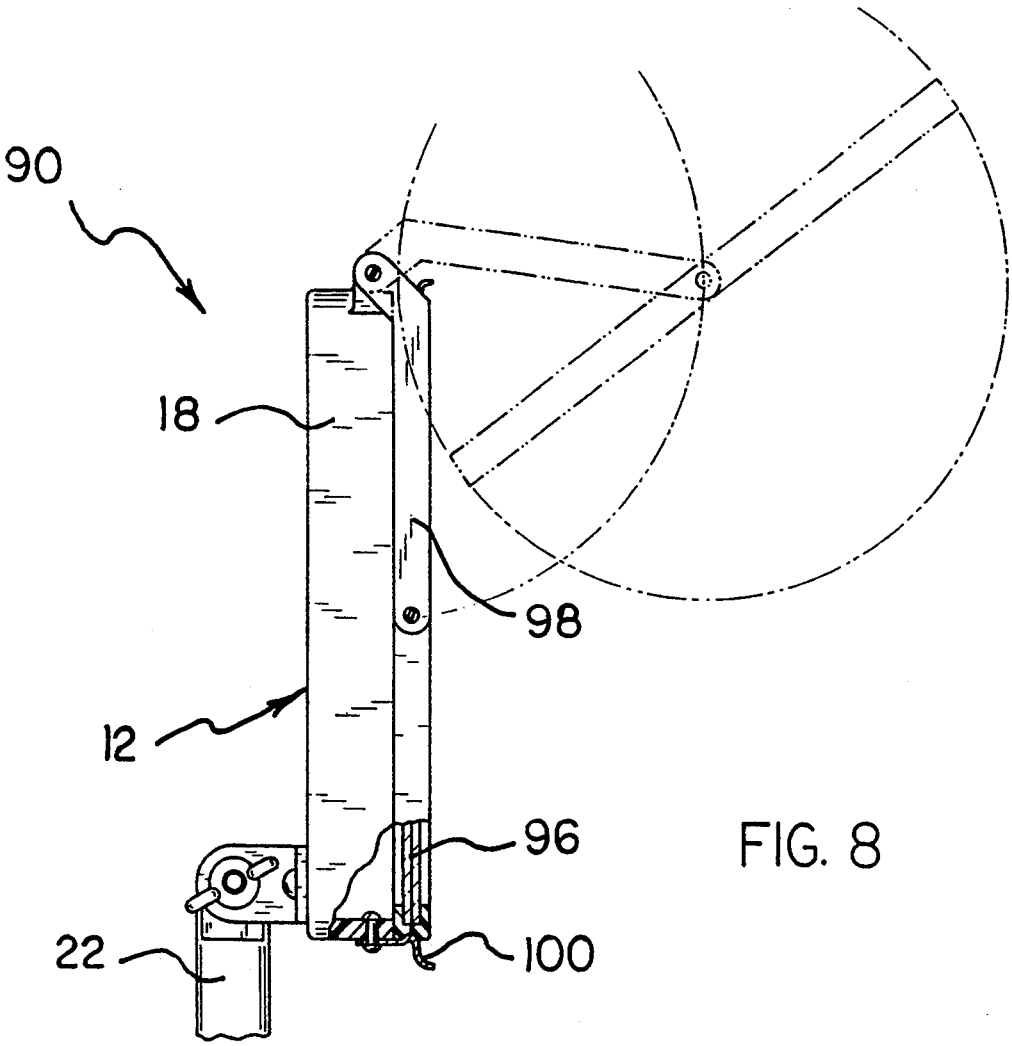
FIG. 8 is a side elevation view, partially in cross section, of the third embodiment as viewed from line 8—8 of FIG. 7.

Comprising substantially all of the features and structure of the previous embodiments 10, 80 is a third embodiment which is generally designated by the reference numeral 90 and may be viewed in FIGS. 7–8. It can be shown that the third embodiment 90 further comprises a magnification assembly 92 that may be removably positioned upon the mirror assembly 12 to provide a substantial magnification of the mirror glass 20 therebeneath. The magnification assembly 92 comprises a lens frame 94 which secures and supports a magnifying lens 96 in a well understood manner.

The magnifying lens 96 is comprised of any substantially transparent material that is shaped in such a manner so as to provide a magnification of objects viewed therethrough. The lens frame is pivotally connected to a pair of lens arms 98 which are in turn pivotally secured to the mirror frame 18 such that the magnifying lens 96 may be removably positioned upon the mirror glass 20 to hold the magnification assembly 92 securely against the mirror assembly 12. A plurality of clips 100 are secured to the mirror frame 18 and are operable to engage the lens frame 94 in a well understood manner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new portable cosmetic mirror apparatus comprising:

a stand comprising a telescoping pole means having a base means for supporting said telescoping pole means in a substantially vertical orientation, said base means being coupled to a lower end of said telescoping pole means, said telescoping pole means being operable to be extended to various heights;

a mirror pivotally coupled to a top end of said telescoping pole means;

a magnification means pivotally coupled to said mirror for selectively magnifying said mirror; and, a holding means pivotally coupled to a portion of said telescoping pole means for releasably holding a hair appliance proximal said mirror.

2. The portable mirror apparatus of claim 1, wherein said telescoping pole means comprises an upper member slidably disposed within a medial member, said medial member being slidably disposed within a lower member, said lower member being coupled to said base means.

3. The portable mirror apparatus of claim 2, wherein said base means comprises a slider positioned upon an exterior of said lower member, an end cap secured to a lower end of said lower member, a plurality of legs pivotally coupled to said slider in a spaced relationship theraround, and a plurality of supporting arms each pivotally coupled to both said end cap and one of said plurality of legs.

4. A new portable cosmetic mirror apparatus comprising:

a stand comprising a telescoping pole means for extending to various heights and a base means for supporting said telescoping pole means in a substantially vertical orientation, said telescoping pole means comprising an upper member slidably disposed within a medial member, said medial member being slidably disposed within a lower member, with said lower member being coupled to said base means, and a locking means for selectively retaining said upper member relative to said medial member and said medial member relative to said lower member, said base means comprising a slider positioned upon an exterior of said lower member, an end cap secured to a lower end of said lower member, a plurality of legs pivotally coupled to said slider in a spaced relationship theraround, and a plurality of supporting arms each pivotally coupled to both said end cap and one of said plurality of legs;

a mirror pivotally coupled to a top end of said telescoping pole means;

a magnification means pivotally coupled to said mirror for selectively magnifying said mirror; and, a holding means pivotally coupled to a portion of said telescoping pole means to releasably holding a hair appliance proximal said mirror.

* * * * *